US005904123A

United States Patent [19]

Ammon et al.

[11] Patent Number: 5,904,123

[45] Date of Patent: May 18, 1999

[54] MECHANICAL VALVE TAPPET

[75] Inventors: Reinhard Ammon, Nuremberg; Robert Kamm, Veitsbronn, both of Germany

[73] Assignee: Ina Walzlager Schaeffler oHG, Germany

[21] Appl. No.: 09/075,054

[22] Filed: May 8, 1998

[30] Foreign Application Priority Data

May 26, 1997 [DE] Germany ..... 197 21 855
Apr. 8, 1998 [DE] Germany ..... 198 15 790

[51] Int. Cl.[6] ..... F01L 1/14; B23P 15/00

[52] U.S. Cl. ..... 123/90.51; 29/888.03; 29/888.43; 72/414

[58] Field of Search ..... 123/90.48, 90.51, 123/90.52; 29/888.03, 888.43; 72/414

[56] References Cited

U.S. PATENT DOCUMENTS

| | | | |
|---|---|---|---|
| 4,829,950 | 5/1989 | Kanamaru et al. | 123/90.51 |
| 5,537,744 | 7/1996 | Hirose | 29/888.43 |
| 5,706,772 | 1/1998 | Hara | 123/90.52 |
| 5,724,734 | 3/1998 | Hirose et al. | 29/888.43 |

FOREIGN PATENT DOCUMENTS

| | | | |
|---|---|---|---|
| 0592908 | 4/1994 | European Pat. Off. . | |
| 2656898 | 7/1991 | France . | |
| 2946682 | 5/1981 | Germany . | |
| 3034951 | 4/1982 | Germany . | |
| 3149356 | 6/1983 | Germany . | |
| 4406407 | 8/1995 | Germany . | |
| 63-100204 | 5/1988 | Japan | 123/90.51 |
| 3-149304 | 6/1991 | Japan | 123/90.51 |
| 5-98914 | 4/1993 | Japan | 123/90.51 |

OTHER PUBLICATIONS

JP 6–17609 A., Patent Abstracts of Japan, M–1596, Apr. 25, 1994, vol. 18, No. 224.

J 08042310 A., Patent Abstracts of Japan, Haruki, Direct Acting Valve . . . Engine Feb. 13, 1996.

*Primary Examiner*—Weilun Lo

*Attorney, Agent, or Firm*—Bierman, Muserlian and Lucas

[57] ABSTRACT

A mechanical valve tappet for timing the valves of an internal combustion engine comprising a cup-shaped housing (1), consisting of a hollow cylindrical wall (2) closed at one end by a bottom (3) which is exteriorly contacted by a control cam (6), while on the inner surface of the bottom (3), there is arranged an elevation (4) which cooperates with the end of a valve stem of a gas exchange valve (5) and while the other dimensions of the valve tappet remain unchanged, the elevation is made in each case with a different axial extent whereby the valve clearance can be adjusted without the adjusting elements hitherto required by the prior art by inserting the entire cup-shaped housing (1) having the appropriate elevation (4) into the cylinder head.

2 Claims, 3 Drawing Sheets

MECHANICAL VALVE TAPPET

FIELD OF THE INVENTION

A mechanical valve tappet arranged in a guide bore of a cylinder head of an internal combustion engine and comprising a cup-shaped housing having a hollow cylindrical wall closed at one end by a bottom which is contacted exteriorly by a control cam while on an inner surface of the bottom, there is arranged an elevation which cooperates with an end of a valve stem of a gas exchange valve as well as a method of making such a valve tappet and apparatus for carrying out the method.

BACKGROUND OF THE INVENTION

Mechanical valve tappets of the above generic type have been known for a long time. Thus, for example, DE-AS 22 47 069 shows a cup tappet which, on the surface of its bottom facing away from the cam comprises an elevation pointing towards a valve stem and bearing with the help of a surrounding shim against the end of the valve stem. The required correction of valve clearance is effected after a defined operational performance by replacing the shim. A drawback of the said structure is that, on the one hand, the shims have to be manufactured and stocked in different thicknesses as additional parts and, on the other hand, the adjustment of valve clearance is made more difficult because the shim is a separate part necessitating additional handling.

OBJECTS OF THE INVENTION

It is an object of the invention to create a mechanical valve tappet which permits a simplified adjustment of valve clearance.

This and other objects and advantages of the invention will become obvious from the following detailed description.

SUMMARY OF THE INVENTION

The novel set of mechanical valve tappets of the invention each comprising a cup-shaped housing (1) having a hollow cylindrical wall (2) closed at one end by a bottom (3) for contact exteriorly by a control cam (6) wherein on the inner surface of the bottom (3), there is arranged an elevation (4) for cooperation with the end of a valve stem of a gas exchange valve (5) and wherein the heights of the elevations differ for different tappets of the said set and the remaining tappet dimensions are the same for different tappets of the said set. While the other dimensions of the valve tappet remain unchanged, the elevation is made in each case with a different axial extent.

This means that for adjusting valve clearance in a particular case, a valve tappet is used whose elevation has the axial extent required to correct the valve clearance measured in this case. The complete replacement of a mechanical valve tappet by a new one substantially simplifies the adjusting operation because during this operation it is only the valve tappet itself that has to be handled. The hitherto required compensating shims for adjusting valve clearance can therefore be dispensed with. This, in turn, means that the shims no longer need to be manufactured as separate spare parts nor to be stocked at high costs in different dimensions.

According to further advantageous features of the invention, the axial extent of the elevation should be varied from tappet to tappet in uniform steps, the variation should be in steps of 100 $\mu$m, and the axial extent of the elevation should be smaller than or equal to three times the original thickness of the bottom.

The method provided by the invention for making the valve tappet is characterized in that the cup-shaped housing is formed by a cold shaping process such as deep drawing or extrusion molding from a circular blank punched out of a cold or hot rolled strip. A force F1 is then applied to the inner surface of the bottom of the housing to produce a high pressure so that by a backward plastic flow of the bottom, the elevation is formed without a simultaneous denting of the material of the bottom.

The plastic flow can be pre-defined to create any desired shape of the inner contour of the bottom. Thus, for obtaining a valve tappet with a high stability and strength and as low a weight as possible, it would be appropriate to configure the inner contour of the bottom so that it is at the thickest at the center and becomes thinner towards the edge. To put it differently, the inner contour of the bottom is adapted to the loading conditions, i. e. the region of contact with the cam is configured to be the strongest.

In an advantageous development of the invention, the flow of material takes place in a direction opposed to the force F1, towards the elevation and towards the hollow cylindrical wall. Besides the actual formation of the elevation, this backward extrusion in the direction of the elevation and in the direction of the cylindrical wall has the advantage that the valve tappet is particularly stable in the region of the hollow cylindrical wall.

According to a further feature of the invention, a counterforce F2 which is less than the force F1 is applied to the elevation. This counterforce serves to avoid the formation of a region of short volume in the form of a dent on the outer surface of the bottom which is contacted by the cam.

Finally, an apparatus for making a mechanical valve tappet including a matrix (7), a stamping die (9) and at least one counterdie (8) whereby material my be pressed under the action of pressure into cavities (12, 13) formed between the matrix, stamping die and counterdie, and wherein the countour of the stamping die (9) corresponds to the inner contours of the bottom (3).

BRIEF DESCRIPTION OF THE DRAWINGS

The invention will now be described more closely with the help of the following example of embodiment illustrated in the drawings.

DETAILED DESCRIPTION OF THE DRAWINGS

Figure 1:
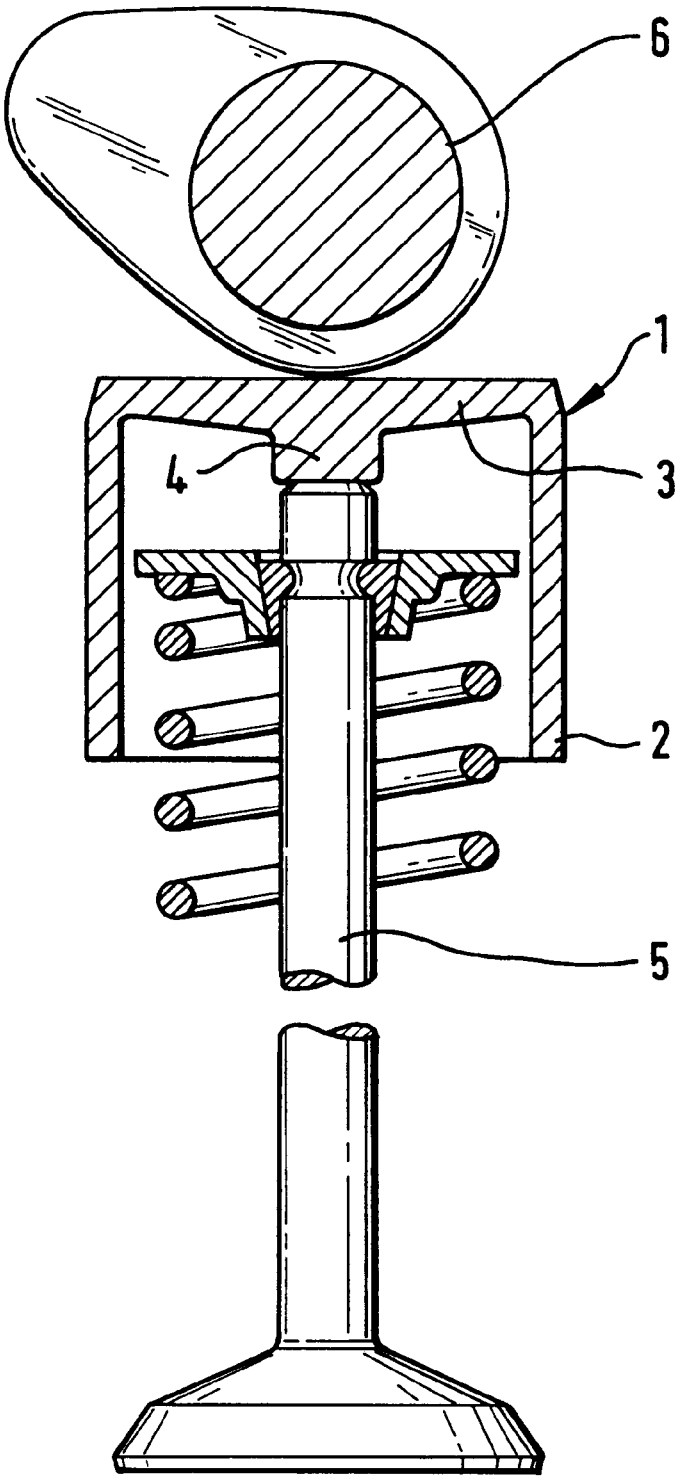
FIG. 1 is a side view of a mechanical valve tappet in partial cross-section.

The mechanical valve tappet shown in FIG. 1 comprises a cup-shaped housing 1 whose hollow cylindrical wall 2 is closed at one end by a bottom 3. In the direction of the open end of the cup-shaped housing 2, the bottom 3 is provided with an elevation 4 which cooperates with the end of a stem of a gas exchange valve 5. The bottom 3 is loaded from the top by a cam 6. For correcting the clearance of the gas exchange valve 5, it is now no longer a shim that is exchanged as in the state of the art but, in accordance to the invention, the entire cup-shaped housing 2 is replaced by another having the desired axial dimension.

Figure 2:
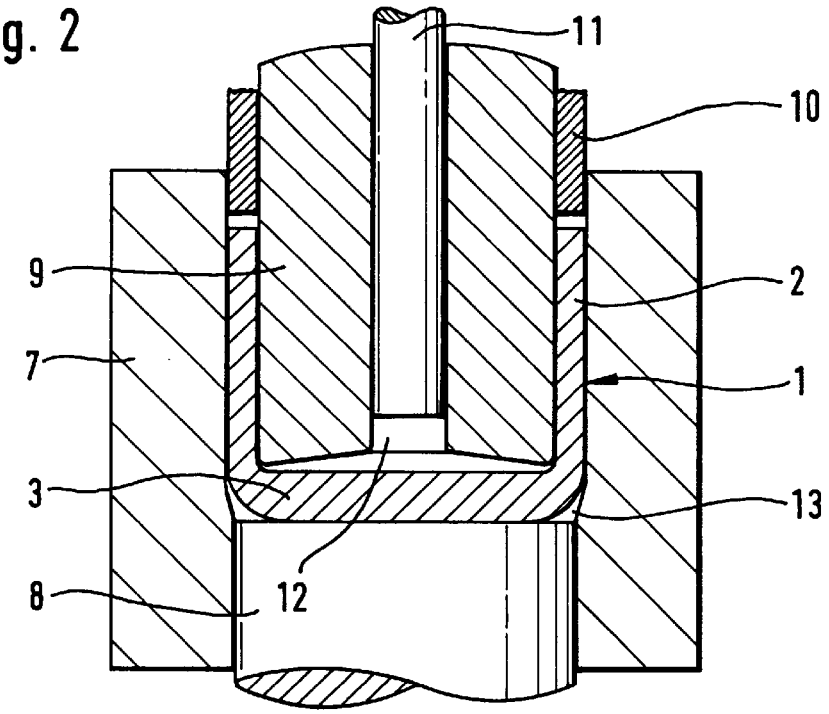
FIGS. 2 and 3 show a cup-shaped housing of a mechanical valve tappet before and after the stamping of the bottom.

The blank of a cup-shaped housing 1 represented in FIG. 2 is made by a cold shaping process, for example extrusion molding, from a circular blank cut out of a cold or hot rolled strip, cold shaping processes permitting the obtention of clean surfaces with a relatively high end precision. This blank of a cup-shaped housing 1 consisting of a hollow cylindrical wall 2 and a bottom 3 is placed in a matrix 7 which engages uniformly around its outer peripheral surface on all sides. The bottom 3 of the cup-shaped housing 1 is supported on a counterdie 8 while, on the open end of the cup-shaped housing 1, there is arranged in spaced relationship thereto, a further counterdie 10.

Figure 3:
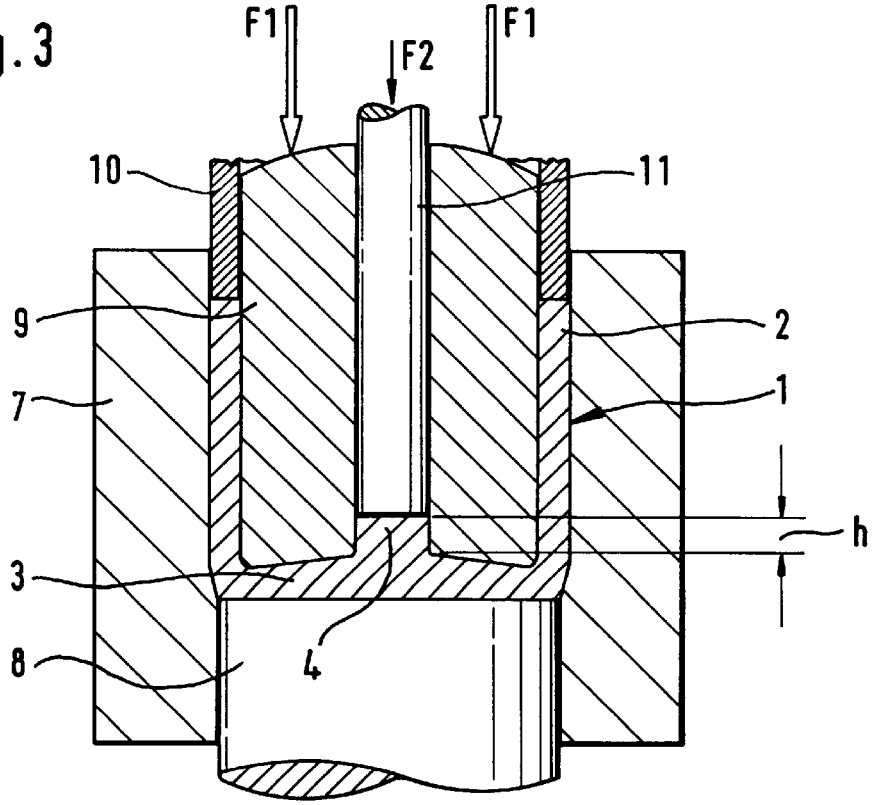
Figure 4:
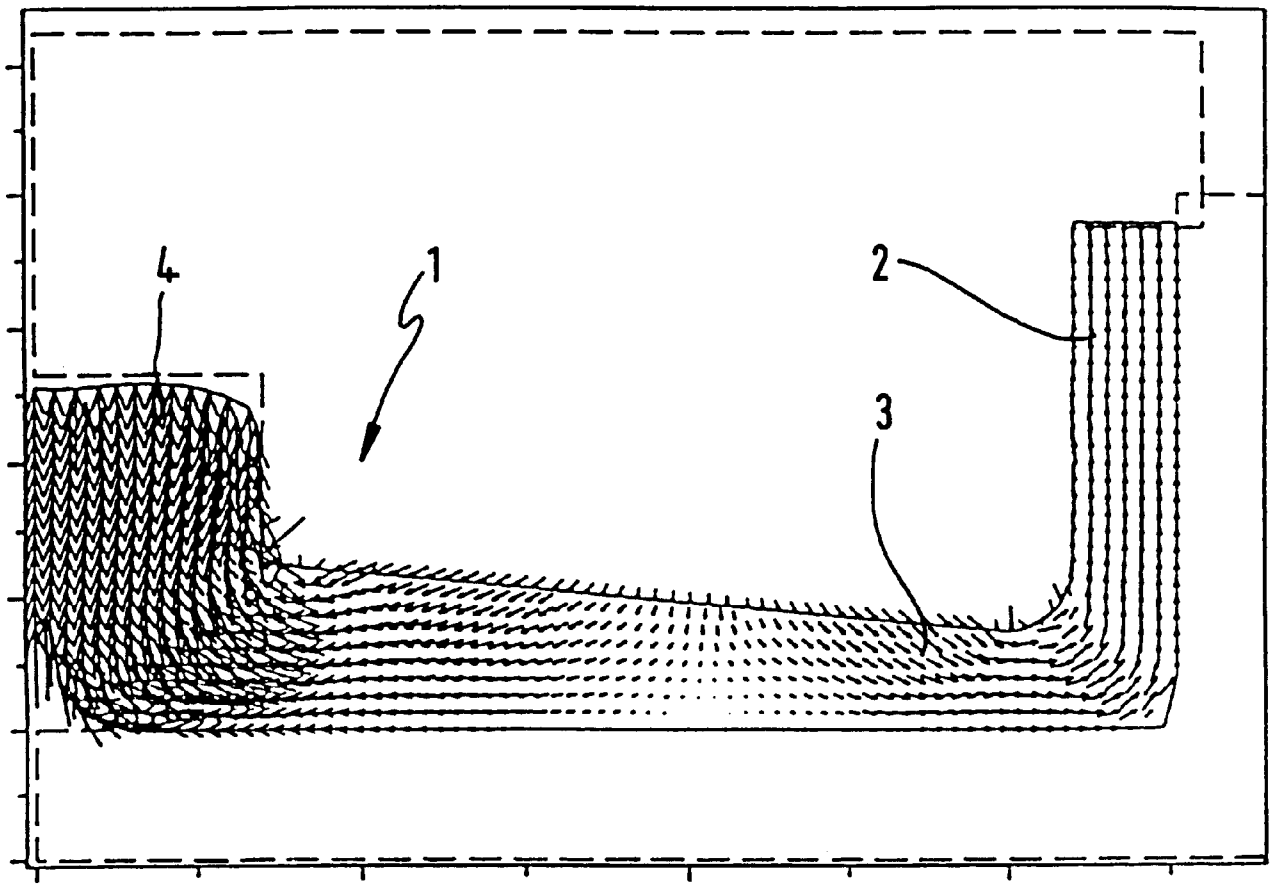
FIG. 4 is a graphical representation of the flow behaviour of the bottom during the stamping process.

If now, as shown in FIGS. 3 and 4, a force F1 is applied to the inner surface of the bottom 3 by a stamping die 9 from the top, a portion of the material of the bottom 3 begins to flow plastically into a cavity 12 defined by the stamping die 9 and the conterdie 11. Another part of the material of the bottom 3 flows into a further cavity 13 defined on one side by the matrix 7 and the counterdie 8 and on the other side by the cup-shaped housing 1. In other words, for forming the elevation 4, the bottom is plastified, i. e. the bottom 3 is reinforced in the region of the elevation 4 by a partial accumulation of material without an indentation of material occurring on the opposite side of the elevation 4. A pressing force of 2,000 to 3,000 $N/mm^2$ is required for plastifying the bottom 3.

The counterdie 11, which is guided for axial displacement in a recess, not referenced, of the stamping die 9, loads the elevation 4 which is in the process of being formed with a counterforce F2 which is substantially less than the force F1 and prevents the formation of a short volume in the form of a material indentation on the surface of the bottom 3 facing the cam 6.

FIGS. 2 and 3 also show that the end of the stamping die 9 is matched to the inner contour of the bottom 3 and that after completion of the metal shaping process, the blank of the cup-shaped housing 1 fills the cavities 12 and 13, i. e. the cup-shaped housing 1 has attained its final shape. From FIG. 3, it will be clear to a person skilled in the art that the axial height h of the elevation 4 can be varied by changing the positions of the shaping elements 10 and 11 relative to each other. Following this, if necessary, the cup-shaped housing 1 which has its final shape can be machined and subjected to a heat treatment to increase hardness.

In FIG. 4, the behavior of the material of a cup bottom 3 is represented in a flow diagram by a plurality of small arrows. The arrows show both the flow direction and the approximate speed of flow because the length of the arrows is correlated with the flow speed. It can be clearly seen that a neutral flow plane is situated approximately at the radial center of the bottom 3 in the present example. This means that the material of the bottom 3 flows from this location at first radially inwards and outwards to then continue its plastic flow axially upwards in the direction of the elevation 4 and in the direction of the hollow cylindrical wall 2.

It is understood that the invention is not limited to the example of embodiment of a mechanical valve tappet with an additional shaped element in the form of an elevation 4. The method can be applied in general to any sheet metal shaped part out of which an additional shaped element is to be formed by a plastic deformation of material. The cross-sectional geometry and the height of the additional shaped element can be freely chosen and can be a multiple of the original thickness of the sheet metal.

Various other modifications of the tappet, method and apparatus of the invention may be made without departing from the spirit or scope thereof and it is to be understood that the invention is intended to be limited only as defined in the appended claims.

What we claim is:

1. A method of making a mechanical valve tappet for being arranged in a guide bore of a cylinder head of an internal combustion engine having a cup-shaped housing (1) with a hollow cylindrical wall (2) closed in a direction opposed to a force (F1), towards a protrusion (4) and towards the hollow cylindrical wall (2) closed at one end by a bottom (3), an outer surface of said bottom (3) is being contacted exteriorly by a control cam (6) while on an inner surface of said bottom (3), the protrusion (4) cooperates with an end of a valve stem of a gas exchange valve (5), while other dimensions of the valve tappet remain unchanged, the protrusion (4) is made in each case with a different axial extent, comprising the steps of forming said cup-shaped housing (1) by a cold shaping process from a circular blank punched out of a cold or hot rolled strip, and applying a force (F1) to an inner surface of said bottom (3) to produce a high pressure so that by a backward plastic flow of material of the bottom (3), in a direction opposed to the force (F1), towards the protrusion (4) and towards the hollow cylindrical wall (2), forming the protrusion whereby a counterforce (F2) which is lower than the force (F1) is applied to the protrusion (4), so that a formation of a short volume in a form of a dent of said outer surface is avoided.

2. The method of claim 1 wherein the cold shaping process is deep drawing or extrusion molding.

* * * * *